US006446368B1

(12) United States Patent
Watts

(10) Patent No.: US 6,446,368 B1
(45) Date of Patent: Sep. 10, 2002

(54) INNOVATIVE INCLINED PLANE EARTH ENGAGING TOOL

(75) Inventor: Cleal T Watts, Dallas, TX (US)

(73) Assignee: Cleal Watts

( * ) Notice: Subject to any disclaimer, the term of this patent is extended or adjusted under 35 U.S.C. 154(b) by 0 days.

(21) Appl. No.: 09/417,963

(22) Filed: Oct. 13, 1999

(51) Int. Cl.[7] ..... E02F 9/28
(52) U.S. Cl. ..... 37/450; 37/451
(58) Field of Search ..... 37/446, 449, 450, 37/451, 452, 453, 454, 460; 172/753, 749, 772, 772.5

(56) References Cited

U.S. PATENT DOCUMENTS

| | | | | | |
|---|---|---|---|---|---|
| 2,124,230 | A | * | 7/1938 | Hosmer et al. | 37/460 |
| 2,250,904 | A | * | 7/1941 | Coffman | 37/453 |
| 2,251,487 | A | * | 8/1941 | Hosmer et al. | 37/453 |
| 2,433,001 | A | * | 12/1947 | Mork | 37/453 |
| 2,546,457 | A | * | 3/1951 | Launder et al. | 37/453 |
| 3,550,293 | A | * | 12/1970 | Helton | 37/450 |
| 3,648,391 | A | * | 3/1972 | Kabay et al. | 37/453 |
| 3,888,027 | A | * | 6/1975 | Toews | 37/460 |
| 4,326,348 | A | | 4/1982 | Emrich | |
| 4,428,131 | A | | 1/1984 | Hahn | |
| 4,587,751 | A | | 5/1986 | Sjogren et al. | |
| 4,716,667 | A | | 1/1988 | Martin | |
| 4,748,754 | A | | 6/1988 | Schwappach | |
| 4,753,299 | A | * | 6/1988 | Meyers | 172/777 |
| 5,016,365 | A | | 5/1991 | Robinson | |
| 5,056,243 | A | | 10/1991 | Sprunger et al. | |
| 5,144,762 | A | | 9/1992 | Robinson | |
| 5,224,282 | A | | 7/1993 | Swick | |
| 5,412,885 | A | | 5/1995 | Cornelius | |
| 5,666,748 | A | | 9/1997 | Emrich et al. | |
| 5,743,033 | A | * | 4/1998 | Gegel | 37/460 |
| 5,782,019 | A | * | 7/1998 | Launder et al. | 37/446 |

* cited by examiner

*Primary Examiner*—Victor Batson

(57) ABSTRACT

When added, the inclined plane (22) becomes the earth engaging tool. It is a robust, one piece, durable metal slope. Its leading edge is optionally pointed, narrowed, and thickened for use in consolidated and abrasive earth. Its leading edge fractures and cleaves as it up lifts excavated earth above and beyond its attachment to the implement (28). Working more than one inclined plane (22) in unison and arranged to bridge cleave, results in little to no abrasion to the implement (28), superior excavation performance, and excellent staying.

6 Claims, 8 Drawing Sheets

FIG. 1 - PRIOR ART

FIG. 3 - PRIOR APT

INNOVATIVE INCLINED PLANE EARTH ENGAGING TOOL

BACKGROUND

1. Field of Invention

Figure 1:
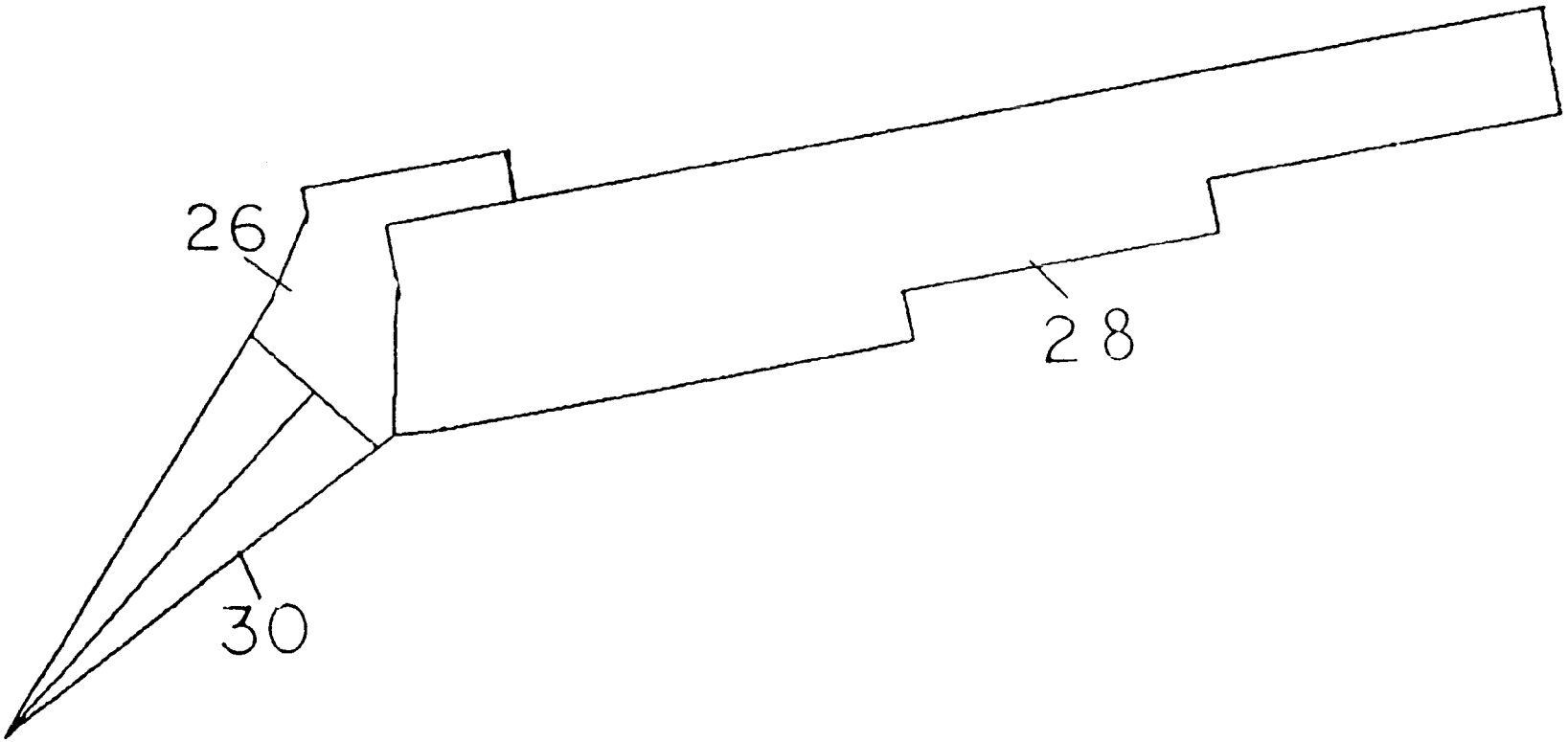

This invention relates to earth working specifically to an earth-engaging tool which is more efficient and robust.

2. Discussion of Prior Art

While the industry has expended much effort to build more effective teeth to use in earth exicovation, they have relied mostly on wedge type teeth. Of the six simple machines, the lever and fulcrum, the windless, the screw, the block and tackle, the inclined plane and the wedge, the wedge is the least efficient because of its friction.

Most of the prior art teeth, wedge earth on the bottom and at the sides. While dragging on the lower leading edge is necessary for cleavage, dragging on the bottom of the tooth, means that additional excavated earth is disturbed or displaced and that extra draft is required. This wedging not only reduces the down pressure needed for nearly every excavation of consolidated earth, but it also creates much additional unwanted abrasive fines and circulates them in the proximity of the supporting structure of an earth working tooth.

These negative effects set up by this wedging including blunting of the front of the teeth, cause unnecessary disturbances in the fluid dynamics of the earth excavated. This requires the expenditure of considerably more energy.

The fact that more fines are generated, also requires more energy to manipulate or crush the fines, more wear and tear, and it increases the cost of the particular excavation operation. There are specialized machines available to reduce earth to fines that are much more efficient than the teeth and their mounting mechanisms. Abrasive fines generated from abrasive earth excavation are channeled through the teeth and the teeth mounting components or supporting structure and thereby cause some serious erosion and reduction in integrity of essential components of the tooth and its structure.

These impediments greatly increase the cost of tooth components. They also cause considerable reduction in work productivity. They increase operating down time and reduce efficiency. They also increase the frequency with which expensive tooth components must be changed and they compound operating expenses.

The Launder et al U.S. Pat. No. 5,782,019 Jul. 21, 1998 shows a contoured tooth with very little sacrificial metal. The teeth are designed to offer less resistance while maintaining a configuration as it wears. But the design of this tooth limits the amount of sacrificial metal mass. This tooth design can require a rather close digging range for the angle of attack. These teeth are also expensive and they too, are designed to wedge through the excavation. Also, in this design there is little protection to the tooth attached implement or lip.

The Emrich et al U.S. Pat. No. 5,666,748 Sep. 16, 1997, is typical of many prior art methods to reduce wear and incorporate small complicated features that are expensive and questionably efficient. They need to be discarded if operated for only a short time with missing pieces. These multiple pieces get more slack as they are being used. This style still does not address adjacent adapter erosion and lip wear as it wedges and channels excavated material past the adapter, part of the implement or the lip on both the upper and underside.

Cornelius U.S. Pat. No. 5,412,885 May 9, 1995 shows a tooth and lip arrangement. Armored about the lip to enhance and protect from abrasion, the bucket tooth, and the adapters, are included in this protection service. It is very expensive and complicated, and if operated with one of its pieces lost or missing, a continued fit could be forfeited and result in expensive repair This patent provides heavy ground engagement protection to its attached implement or the lip. While this design is for highly abrasive exposure, it still leaves expensive pieces exposed to heavy abrasion.

If it is kept working, it requires high maintenance, it is an expensive and complicated additional system for abrasion protection of a lip that is already built for abrasion.

'Lip—cutting edge of any of certain tools, Webster's New World Dictionary of the American Language, Second College Edition.

This expensive lip protection lacks positive overlapping abrasion protection. In effect, a cutting edge is placed and is working over another cutting edge, or one or both jointly are part of the structure. There is a better way to arrange for structure and abrasion protection.

Also this arrangement involves a dual ground engagement. The teeth partially fracture the earth and the lip completes the fracture and cleaves the excavation.

Lip armament is wedged through earthen material with considerable additional energy requirement and very much more abrasion exposure than is necessary.

The labor, material, and down time costs of a harsh abrasive environment of consolidated earth can be devastating and an alternate method of excavation should be used. The teeth fracture a part of the stubborn earth then the lip or the lip armament is required to complete the fracturing and cleave the balanced of the earth in the excavation process.

The above lip protection systems are not simple, not cheap, nor do they have a particularly extended life. Also these protective systems usually do not remain a tight fit to perform their task. There frequently are gaps where tight fitting adapters and the lip are worn, where tight fitting armor pieces were once located.

Pippins U.S. Pat. No. 5,337,495, Aug. 16, 1994, shows further evidence of different methods of abrasion protection of large replaceable sections of bucket teeth. It is a wedge type tooth. It is quite complicated and expensive. And this abrasion protection method offers little protection advantage to the implement or lip.

Robinson of Hensley U.S. Pat. No. 5,016,365 shows several productions of prior art in their teeth and a protector shroud which are detachably mounted on the lip. This patent gives a good description of blunting, page 4, line 6 through 10, gives a good illustration of the potential wear pattern and bluntness of a wedge tooth.

Again we have an example of a complicated, expensive system that is expensive to buy and maintain and more energy is required to operate this wedge type earth engagement.

These systems of lip protection disturb the flow of earth so much that there is an ongoing penalty for the increased loading resistance. This resistance can be substantiated by observing the extra roll of earth that precedes a loading bucket or lip so equipped or by checking fuel consumption or energy records.

In prior art the earth working tooth has functioned as an operating pushed wedge. Its first function is a scarifier, then part a cleaver and part uplifter.

A working tooth on a lip, means then that a portion of the excavation process is shared with the lip. With some of the excavation left scarified, there is insufficient resistance to load the excavation until sufficient surcharge or roll is ahead to force the excavation over the lip.

During forward movement, the lip must gather the loose scarified earth as a roll plus ribs of undisturbed earth left behind the teeth. The lip must now fracture and cleave with sufficient additional energy to uplift the new excavation with the loose roll.

This dual process of circulating and rehandling a sizable percentage of excavation can mean considerable loss of energy.

Much of the lip excavated earth must also be drawn up between the teeth. The greater the percentage of earth that is loaded between the teeth, the greater resistance or energy loss becomes.

As a wedge type tooth wears, it develops a blunt leading edge. The thickness of the slope determines the bluntness of the leading edge.

As a wedge type tooth is tilted to make it more aggressive, it will concentrate the wear atop the tooth, and it will further expose the attachment joints to abrasive earthen excavation.

SUMMARY

My innovative, inclined plane earth engaging tool an accompanying clean up edge, attaches to an implement. This implement replaces the teeth, lip, and combination of accessories as presented in these examples of prior art. The implement is a structural member and ground engagement is left to a specialized inclined plane and a companion cutting edge system. Earth is engaged fractured, cleaved, and uplifted with a one piece one action earth engaging tool. This arrangement separates its abrasive work from its working structure and the implement. Working as several in unison, it can be arranged to bridge cleave. It is constructed and arranged with several times the sacrificial metal, much more efficiency, and several times the working life of prior art.

OBJECTS AND ADVANTAGES OF THE INVENTION

Accordingly several objects and advantages of my invention are:

a. to provide an improved earth engaging tool, b. to provide an earth engaging tool system that is extremely aggressive and that engages and cleaves earth between tools and it makes a single earth engagement in fracturing and cleaving, c. to provide an earth engaging tool that combats the most severe working conditions with superior performance and staying.

d. to provide an inclined plane earth working tool whose system allows individual units acting in unison to develop a bridged cleavage of nearly all oncoming earthen excavation, e. to provide an inclined plane earth engaging tool that nearly totally isolates abrasive earthen excavation from structural components of the tool and the lip or implement, f. to provide an inclined plane earth engaging tool that produces fractured and cleaved earthen excavation at a superior rate for at least the same cost or less, g. to provide a strong inclined plane earth engaging tool that is robust, but is trim and simple and is still able to withstand harsh erosion, h. to provide an inclined plane earth engaging tool whose upper rearward extremities act as a stabilizer that can add to its integrity and stability, i. to provide an inclined plane earth engaging tool that has several times the sacrificial metal of prior art, j. to provide an inclined plane earth engaging tool that is highly adaptable and has all of the above qualities built around one element.

DRAWINGS

FIG. 1. shows a side view of a tooth, an adapter, and an implement of prior art.

Figure 2:
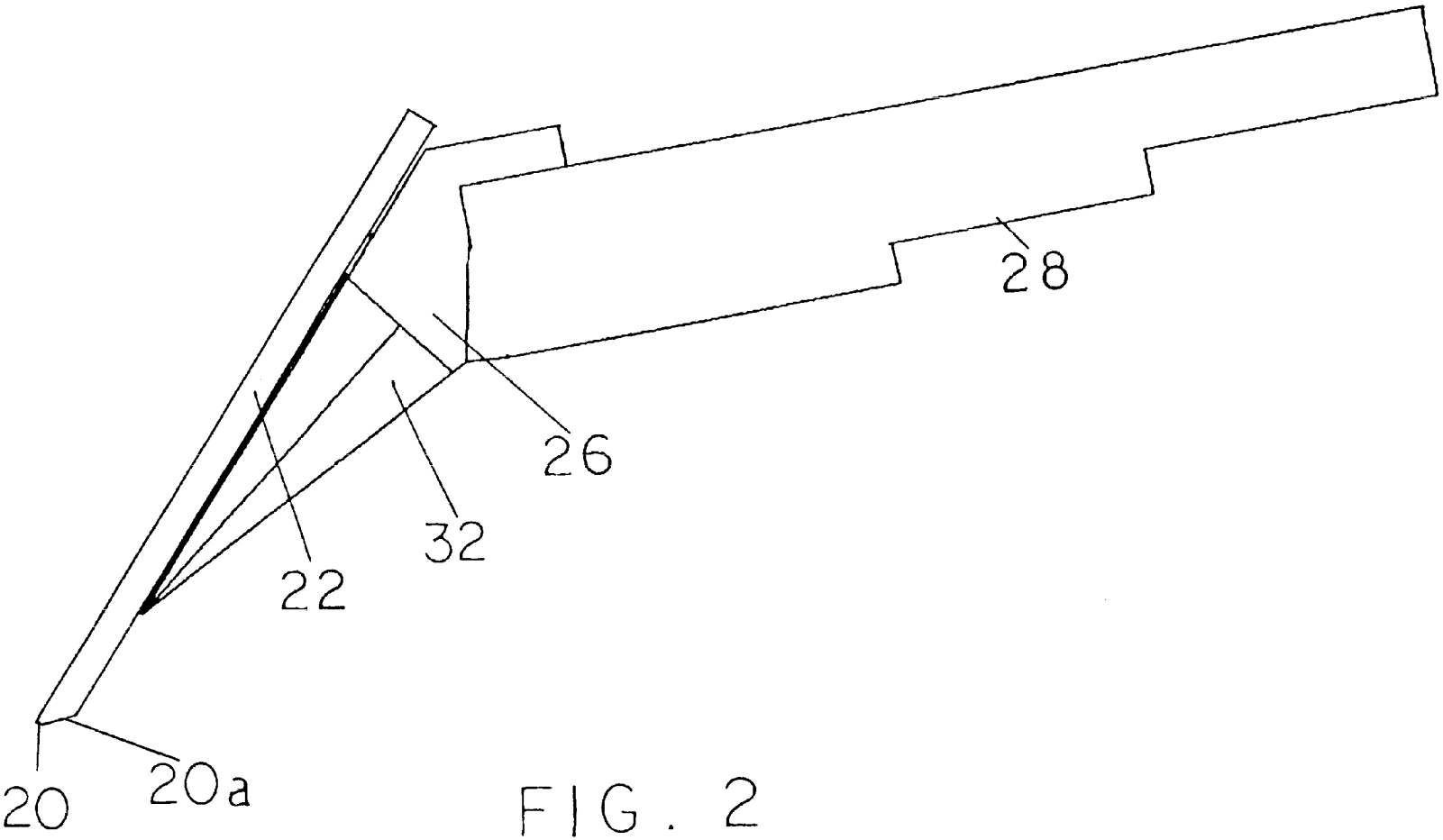

FIG. 2. shows a side view of an inclined plane integrally attached atop a mounting socket, and an adapter attached and part of an implement, with the inclined plane extending over and beyond the attachments according to my invention.

Figure 3:
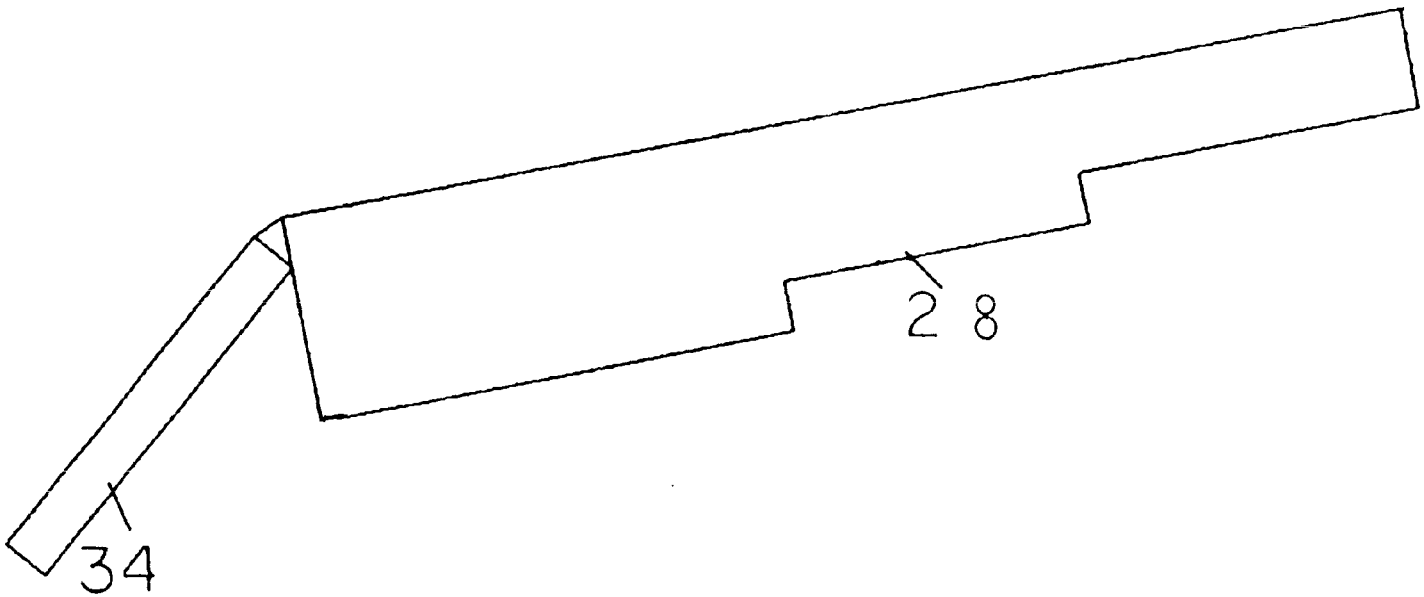

FIG. 3. shows a side view of a former cutting edge attached to an implement of prior art.

Figure 4:
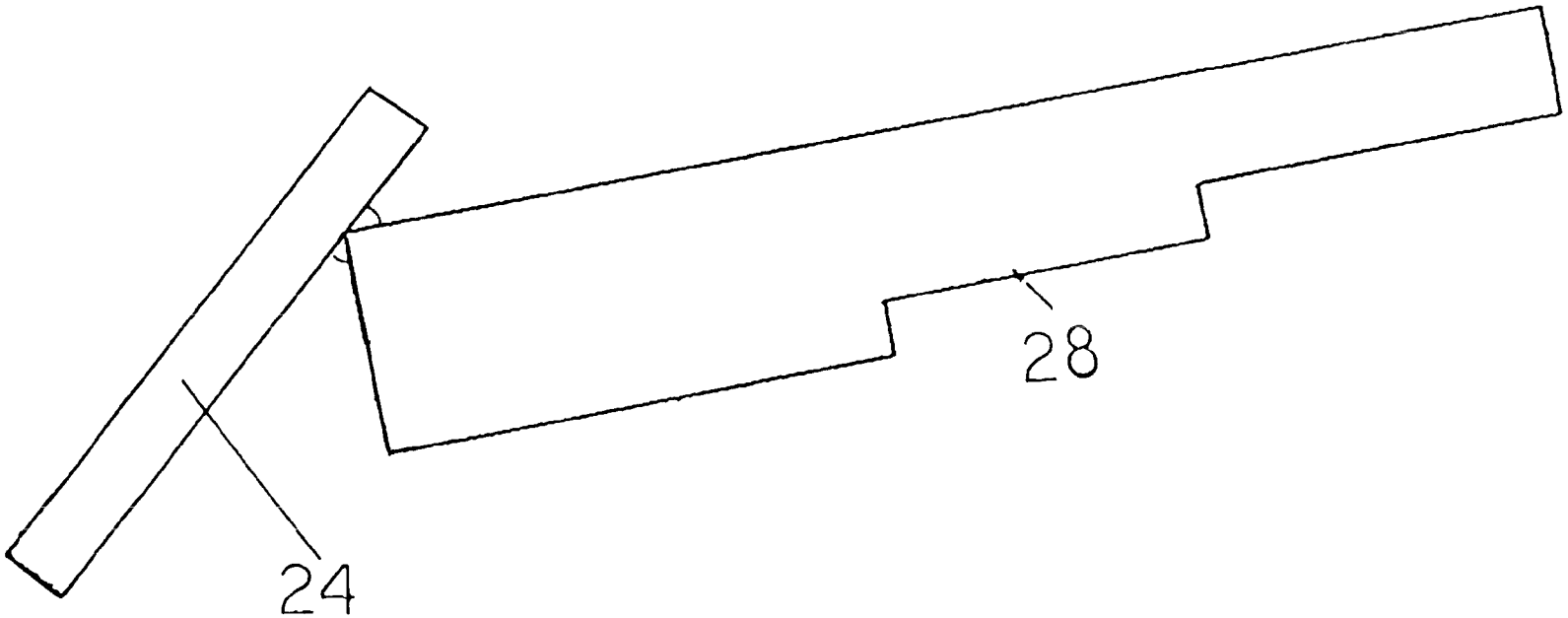

FIG. 4. shows the same side view as FIG. 3 except the clean up edge extends above the implement according to my invention.

Figure 5:
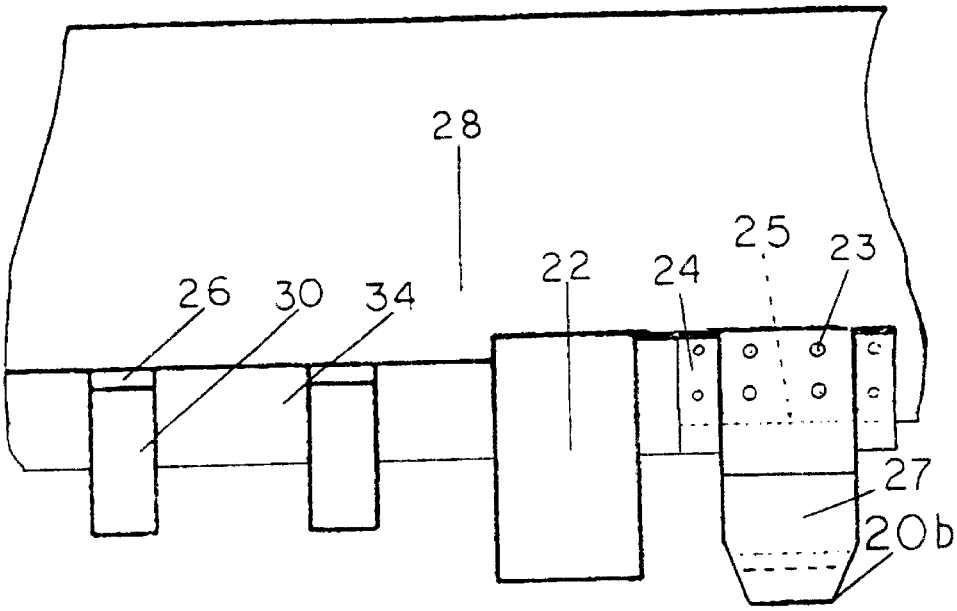

FIG. 5. shown left to right, a top view of two teeth with adapters and a former cutting edge between. There is a second former cutting edge, all of prior art. The second former cutting edge is partially obscured by the overhang of the first inclined plane. It is attached by an integral mounting socket, attached to an adapter, that is attached integral to the implement. An optional, adjoining or attached, half (leave-out) width, clean up edge, is attached to the implement. An adjoining half width, clean up edge is shown fastener attached, to the implement. it may be either adjoining or attached to the second inclined plane. The second inclined plane is shown fastener attached to the implement. The optional wear edge is added to the lower front and is adjoined or attached. Also this second inclined plane is shown pointed and narrowed, and thickened. And, a half, leave-out width, clean up edge, is shown fastener attached to the implement. It also optionally is adjoining or it is attached to the second inclined plane that it accompanies.

Figure 6:
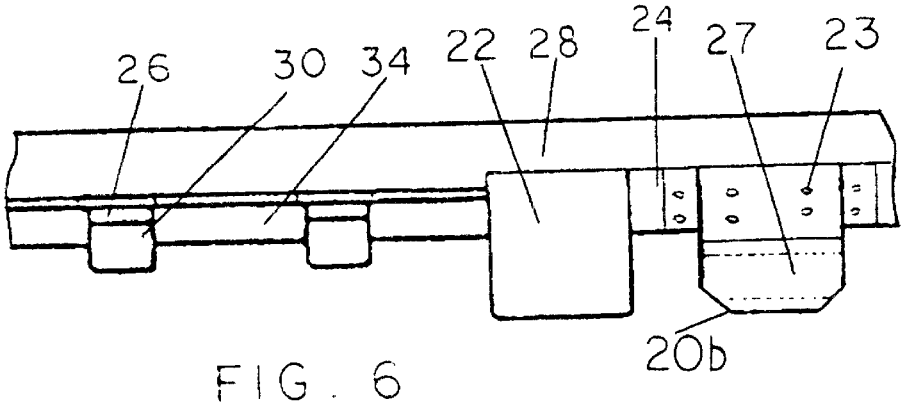

FIG. 6. is a front view of FIG. 5.

Figure 7:
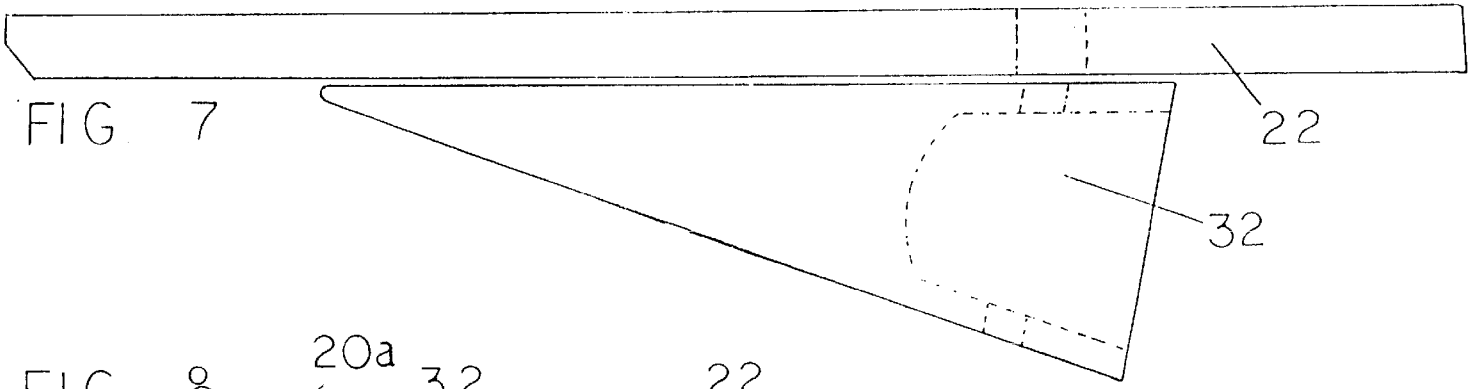

FIG. 7. shows a side view of an inclined plane with an integral mounting socket, in a horizontal position according to my invention.

Figure 8:
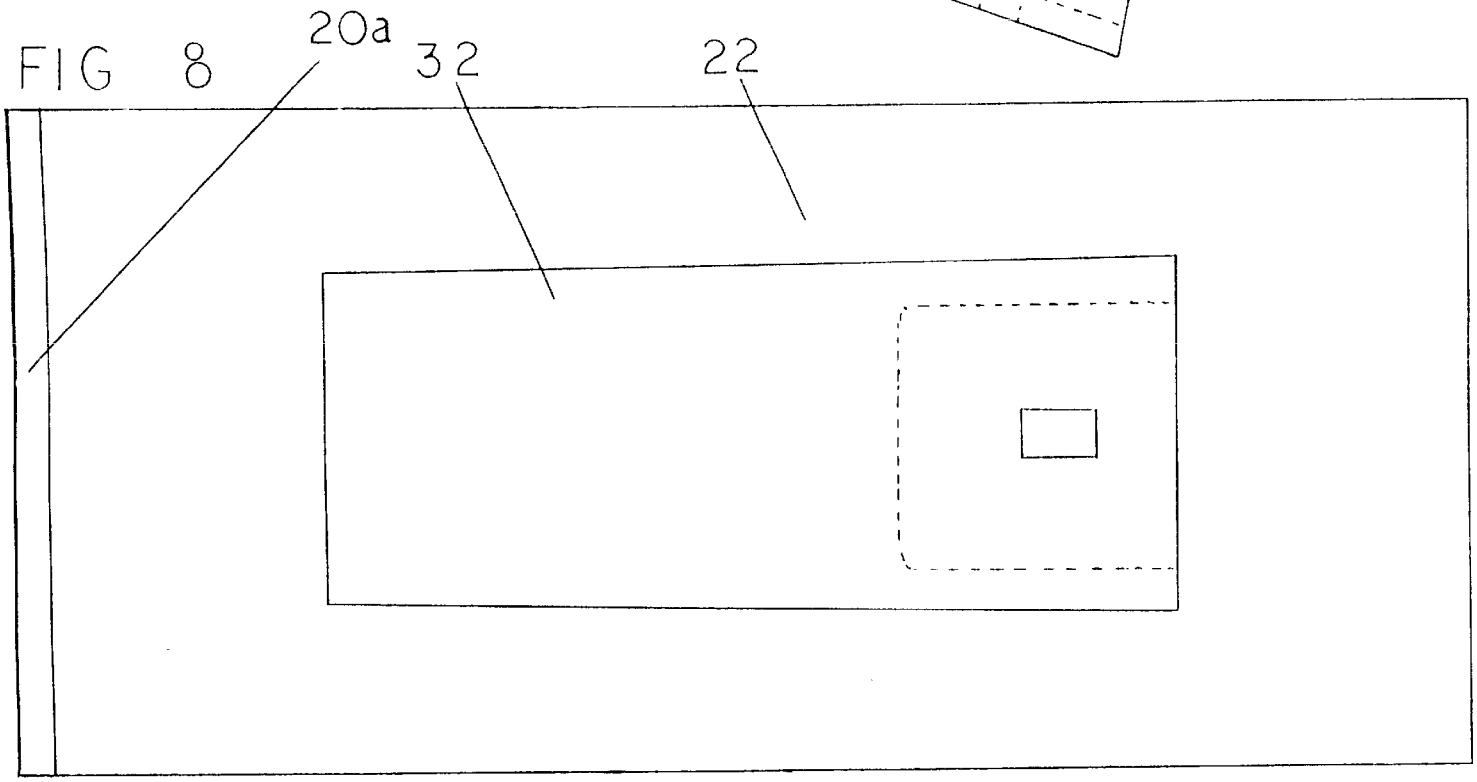

FIG. 8. shows a bottom face view of an inclined plane with an integral mounting socket according to my invention.

Figure 9:
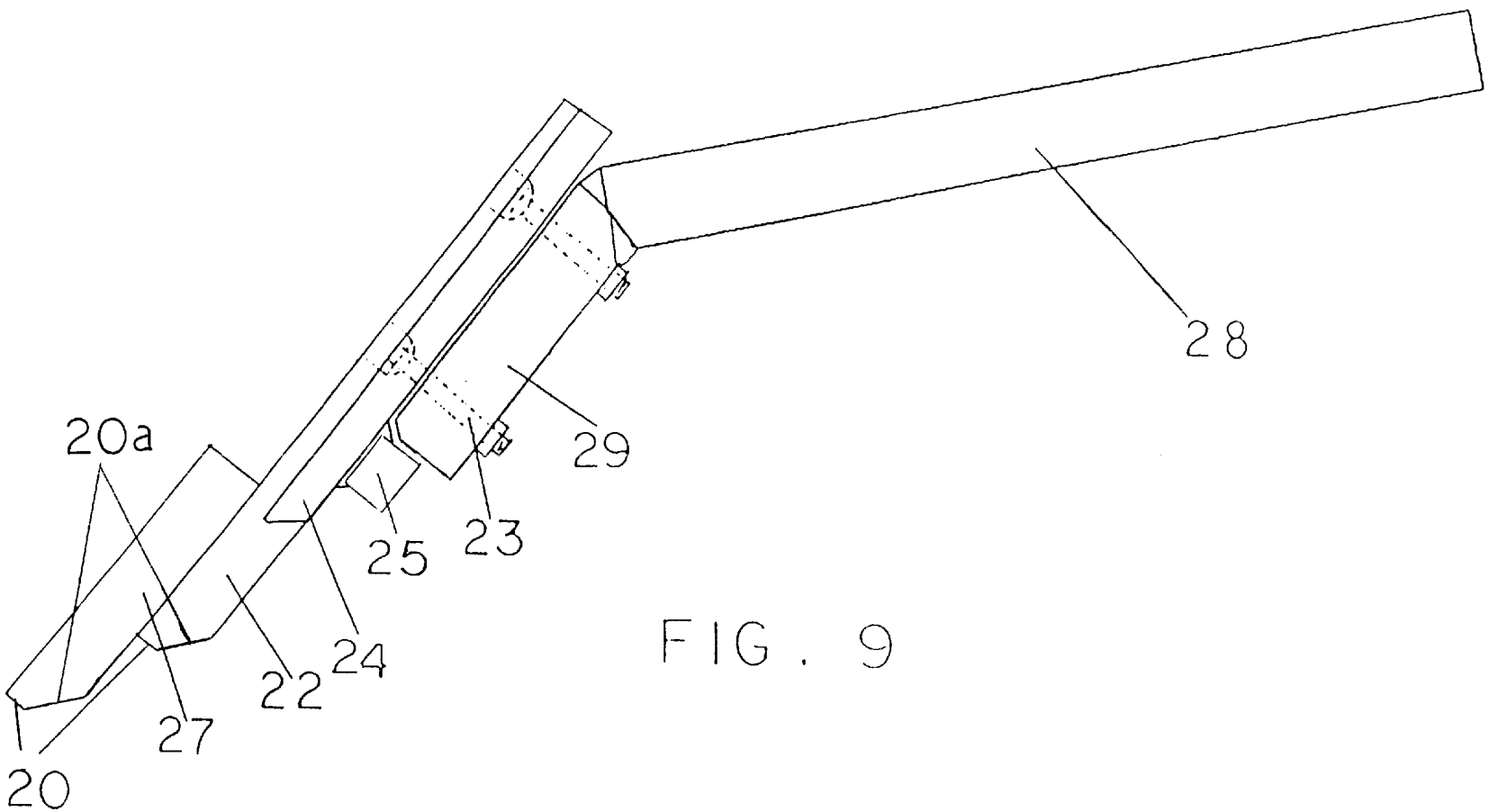

FIG. 9. shows a side view of an inclined plane fastener attached, along with the thrust key and the optional wear edge and a new cutting edge, to an implement according to my invention.

Figure 10:
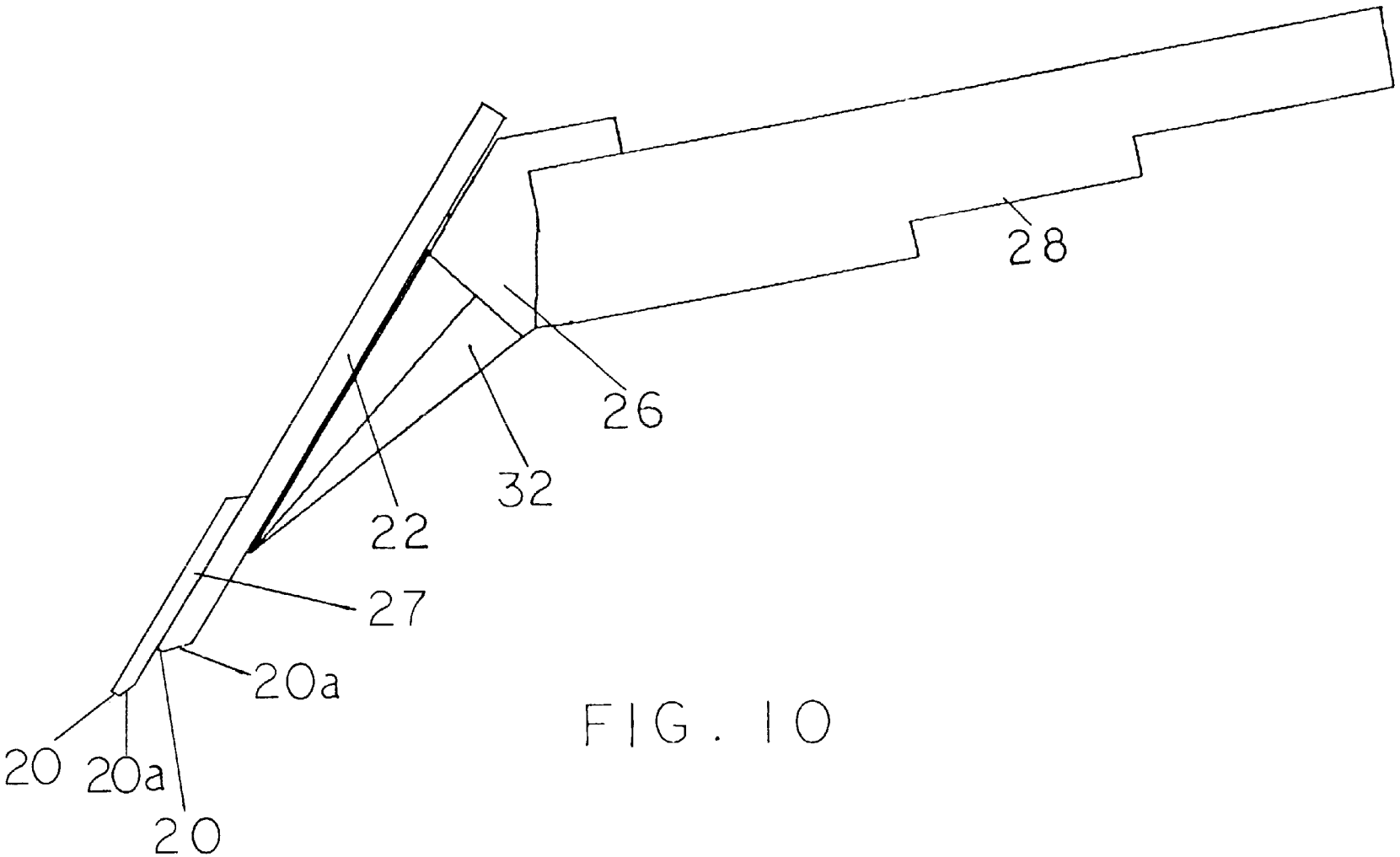

FIG. 10. shows a side view of an inclined plane with additional sacrificial metal according to my invention.

REFERENCE NUMBERS

20 leading edge
20*a* leading edge pointed
20*b* leading edge narrowed
22 inclined plane
23 fastener
24 clean up edge
25 thrust block
26 adapter
27 wear edge
28 implement
29 implement adaption
30 tooth
32 mounting socket
34 former cutting edge

DESCRIPTION

Illustrated in FIG. 1 is a side view of a tooth 30, attached to an adapter 26, attached and made part of an implement 28 of prior art.

Inclined plane 22 replaces an earth working wedge type tooth 30 and is attached integral atop a working tooth 30 or a mounting socket 32, which is attached to an adapter 26 that is attached integral to an implement 28. A working tooth 30 will vary in size, but generally the inclined plane 22 will cast a shadow about twice the size of the tooth 30 that it replaces.

The adapter 26 is a conventional item of prior art. It is necessary that the adapter 26 and the tooth or mounting socket 32 be durable and compatible. A selected line as a G H Hensley of Dallas, TX offers a world wide supply of matched teeth 30 and adapters 26 that can be incorporated and they are not shown in complete detail.

The implement 28, for this description is a propelled durable, metal structural shape used to transmit mobile power. Its cross section is usually as a rectangular prism. It is usually, but not always, straight and it is usually, but not always, used in a near horizontal orientation. A squared off former lip can be readily used for an implement 28. The name lip has intentionally been dropped because the physical shape of the working platform or implement 28 for the inclined plane 22, no longer needs to be a cutting edge.

The inclined plane 22, the clean up edge 24, and the implement adaption 29 are durable metal members. They are of sufficient magnitude constructed with prearranged holes. The location for attachment is prearranged and constructed to receive the fastener attachment 23 that attaches with the proper orientation. As a favored method, the counter sunk holes in the inclined plane align with the prearranged and constructed holes in the implement adaption 29. The implement adaption 29 is attached integral to the implement at the proper angle and location FIGS. 5,6, and 9 to accept a fastener attachment 23 for inclined plane 22 and clean up edge 24 shown, and the attachment of the implement adaption 29. The implement adaption 29 is made integral or part of the implement 28.

The angle of attachment is relevant to the desired angle of ascent of the inclined plane 22 shown in FIG. 9. The implement adaption 29 and fastener 23 attachment are conventional items, they too are illustrated in FIG. 9, but they are not shown in complete detail. They add considerable integrity to the implement 28.

Comparing FIG. 1 with FIG. 2 and FIG. 9, it is easy to recognize that the inclined plane 22 starts out with several times the sacrificial metal of the tooth 30. The rearward overhang, at the high angle uplifting earthen excavation, offers compensating forces for added strength to the inclined plane.

In FIG. 2 a side view shows an inclined plane 22 integrally attached atop a mounting socket 32 or the inclined plane 22, attached to an adapter integrally attached and part of the implement 28 or an attachment made up of the mounting socket 32. Also shown is the inclined plane 22 extending over and beyond the attachments according to my invention. An inclined plane 22 resembles the simple machine by the same name.

The mounting socket 32 is generally wedged shaped and looks similar to the earth working wedge type tooth 30 of the prior art. It has a deep concave socket, rectangular shaped, addressed from the mounting face or the proximal or attachment end of the mounting socket 32. The top and bottom faces of the wedged shaped mounting socket 32 are rectangular shaped, with two tall triangular sides with their apex forward. The mounting socket 32 very much resembles an earth working tooth 30 and it may be substituted for a mounting socket 32.

Its width is almost half its length, if it is being used in the usual 66% cut with a 34% leave out arrangement. Generally the thickness of the inclined plane 22 is approximately 5% to approximately 10% of the length. However, the first, approximately one third, is thicker than the rest to offset the disproportionate wear of this area, FIGS. 5,6,9 and 10.

The inclined plane 22 of the earth engaging tool, is shown in the drawings with at least three optional configurations of the leading edge 20.

(a) The leading edge 20, of the inclined plane 22 is considered leading edge pointed 20*a*, when a portion of the lower face is left out, on approximately a 45 degree corner bevel. The percentage of leading edge remaining defines the degree of pointedness.

(b) The leading edge 20 of the inclined plane 22 is considered a leading edge narrowed 20*b*, when it is arranged and constructed, so that leave out portions, of the leading edge 20, at very short prearranged distances rearward, diminish, to return to the full width of the inclined plane.

Pointing and narrowing configurations of the leading edge reduce the frontal area and increase penetration pressures while using the same effort.

(c) The leading edge 20 of the inclined plane 22 is considered a leading edge 20 thickened, by the addition of sacrificial metal.

This thickened durable section of metal is rectangular shaped, and is called a wear edge 27. It is approximately the same thickness, approximately the same width and approximately half the length of the inclined plane. The lower, forward, extended, portion of the wear edge 27 is mostly congruent, to the lower, forward, portion of the inclined plane, previous to thickening.

The thickened wear edge 27 is constructed by casting or fabricating and it attaches approximately the first one third of the length atop the inclined plane 22. The wear edge 27 leading edge 20, is shown in FIGS. 9 and 10 as a leading edge pointed 20*a*, as it is shown in the original inclined plane 22.

In FIGS. 9 and 10, the wear edge 27, is shown attached to the inclined plane 22 and overhanging approximately the first third of the inclined plane 22.

The thrust block 25, FIG. 9, attaches to the inclined plane 22. It is arranged and constructed to attach approximately midway of the inclined plane 22 on its underside.

The inclined plane 22 is directly adjoining and may be attached to the half section of its companion clean up edge 24, as a way to unitize and additionally secure the inclined plane 22 to the implement 28.

A favored lower forward over lapping wear edge 27 commences its attachment to the inclined plane approximately one sixth of the length of the inclined plane ascending. The wear edge 27 continues its ascending and attachment, either cast or fabricated, and terminates at approximately a third the length the top side of the inclined plane 22, ahead of its first attachment location to the implement 28.

The wear edge 27 significant thickness increase is to approximately the first one third the length of the inclined plane 22. The transition may include as much as one half of the length of the inclined plane. This wear edge 27 is incorporated as a way to withstand harsh abrasive earthen excavation.

An inclined plane 22 earth engaging tool commences with its leading edge 20 and at approximately its midsection, attaches to the integral mounting socket 32 arrangement. The inclined plane overhangs all sides FIG. 8, including its attachment to an adapter 26 which is attached to the implement 28, with the inclined plane 22 continuing atop and beyond this attachment.

An inclined plane 22 earth engaging tool is constructed either cast or fabricated of a durable metal that is 375 Brinell hardness or more. This hardness provides for better resistance in its exposure to extreme abrasion that can be encountered in earthen excavation.

At 66% of cut and 34% leave out between each inclined plane 22, there is approximately 25% overhang FIG. 8 on each side when used atop a mounting socket 32. This dimension will vary with the percentage of cut to leave out.

Illustrated in FIG. 1 is a side view of a prior art earth working tooth 30 with a concave mating surface attached to an adapter 26 with a like convex matching shape. Accompanying clean up edge 24, FIGS. 4,5,6, and 9 is approximately half the length of inclined plane 22, and one is located on each side of inclined plane 22 FIGS. 5 and 6. Each fills half the gap between the inclined planes 22. They are constructed to attach to the implement 28 with their upper extremities the same height as the inclined plane 22. Clean up edges 24 may attach integral to the inclined plane 22, FIGS. 5,6 and 9, or unitize, or they may simply adjoin attached only to the implement FIG. 2. The left side of the drawing represents the front or forward portion or the digging direction FIGS. 1,2,3,4,9, and 10. The implement 28 shown is transverse to the longitudinal axis or the direction of earth engagement.

In FIG. 9, the inclined plane 22 earth engaging tool with the thrust block 25 and the wear edge 27 can be constructed by casting or fabricating and it can be attached by welding, or using a fastener system.

At approximately one fourth its length ascending, on the underside of inclined plane 22 FIGS. 2,7 and 8, the mounting socket 32 commences an integral attachment FIGS. 2 and 10.

The inclined plane 22 attached to a mounting socket 32, is attached with approximately one fourth its length ascending to the mounting socket 32 and protruding approximately one fourth its length following the proximal end or mounting face. This can be seen in both FIGS. 2 and 7.

The mounting socket 32 is generally wedged shaped with a deep concave socket rectangular shaped addressed from the mounting face or the proximal or attachment end of the mounting socket 32.

The top and bottom faces of the wedged shaped mounting socket 32 are rectangular shaped, with two tall triangular sides with their apex forward. The mounting socket 32, FIGS. 2 and 7, very much resembles an earth working tooth 30 and it may be substituted for a mounting socket 32.

At approximately three fourths of its length ascending, on the underside of the inclined plane 22, the mounting socket 32 ends its attachment near its rear concave mounting face FIGS. 2 and 7. The last one fourth of the ascending underside of the inclined plane 22 continues atop the adapter 26 and beyond the its attachments over the front of an implement or a lip 28.

The inclined plane 22 with its integral mounting socket 32 attaches to an adapter 26. The top of the adapter 26 is constructed and shaped to make contact with the underside of the rearward protruding inclined plane 22, as shown in FIG. 2.

As can be seen in FIG. 2, the inclined plane 22 earth engaging tool with its integrally attached mounting socket 32 attaches to the adapter 26 and the adapter 26 to the front of an implement 28. There may be several of this arrangement in a row attached to the front of an implement.

The minimum number of inclined planes 22 earth engaging tool for a bucket application, is usually four and probably the average is about six. But this figure depends on the length of the lip and the width of cut.

The usual width of cut of the inclined plane 22 is approximately 66% with a 34% space or leave out between cuts. However, widths of cut from 50 to 90 percent are in the useful range.

The various attachment angles of the mounting socket 32 to the adapter 26, and the adapter 26 to an implement or a lip must fit the desired operating angle. Also the attaching angle of the implement adaption 29 must fit the desired operating angle.

A companion clean up edge 24 is a short and narrow durable metal plane its thickness is approximately 8% of its length and its minimum width varies with the leave out gap, the usual optimum 34% gap with a 66% cut. integrally attached, they are two half leave out gap widths and an inclined plane 22. The inclined planes 22, and the clean up edges 24 make a full width unit.

The clean up edge is attached in front of the implement 28 FIGS. 4,5,6 and 9 between each unit of the inclined plane 22. Clean up edges 24 fill the gaps between the inclined planes 22. The clean up edge 24 can best be compared with the former cutting edge 34 by looking at FIGS. 5 and 6.

Clean up edge 24 is attached or adjoins and is slightly secondary to the generally thicker inclined plane 22. A fastener 23 attachment for the inclined plane 22 and the clean up edge 24 are illustrated in FIGS. 5,6, and 9. The exposed clean up edge 24 can be seen in the leave out area, in FIGS. 5 and 6 and a side view of FIG. 9.

The clean up edges 24 work line commences slightly below the lip 28 as did the former cutting edge 34. Except, that the clean up edge 24 ascends above the lip at approximately the same height as the inclined plane 22, as seen in FIGS. 4 and 9.

An inclined plane constructed of maximum thickness for sacrificial metal, will generally give best penetration by corner beveling approximately a 45 degree angle approximately two thirds of the lower front face leaving a narrow width of metal, approximately one third of its thickness. FIG. 3 illustrates a former cutting edge 34 attached to a lip 28 both of prior art.

In FIG. 5 a slight oblique forward, top view is shown left to right. Two teeth 30 with adapters and a former cutting edge 34, are also shown with the first inclined plane 22 with an integral mounting socket 32, a half section adjoining another half section of a clean up edge 24, both attached to the implement. The second, however, attached to the second inclined plane 22. A second inclined plane 22 attached by a fastener 23 system, with the half section of a clean up edge 24 attached either side of the fastener 23 attached inclined plane 22. The half sections of the clean up edge 24 are attached to 23 either side of the inclined plane 22 are also attached by a fastener 23 system to the implement 28.

In FIG. 6 a front view looking rearward of FIG. 5. The spacing of FIGS. 5 and 6, denotes a 66% of cut by the inclined planes 22 leaving an approximate 34% open area.

In FIG. 7 a side view illustrates a horizontal orientation of an inclined plane 22 integral with a mounting socket 32 or an inclined plane 22 earth engaging tool.

In FIG. 8 a bottom view orientation illustrates an inclined plane 22 integral with a mounting socket 32 or an inclined plane 22 earth engaging tool.

Illustrated in FIG. 9 are a wear edge 27 attached to an incline plane 22, an attached thrust block 25, and near side attached companion clean up edge 24. This Fig shows the midsection support of the inclined plane 22. It also shows the prearranged holes to accept a fastener attachment for inclined plane 22 and clean up edge 24 shown FIG. 9, and the attached implement adaption 29 made integral to the implement 28. A relative position is also shown by FIGS. 5 and 6, also a front and top view of the fastener 23 system attaching the inclined plane and attaching the clean up edge 24. FIG. 5 also shows the attaching by the fastener 23 system to the implement adaption 29.

OPERATION (Summary of Operation)

The inclined plane 22 is an earth engaging tool arranged and constructed to be used as one or several in a set of inclined planes. A structural implement 28 replacing the sharp pointed lip FIG. 3 and teeth 30 can be arranged with one or a set of inclined planes and can be constructed and arranged for an optimum encounter of earth excavation to fracture, cleave and uplift the earth. An expected application would be found on a dragline, shovel, loader type bucket or other earth engaging implement It is a robust, one piece, ascending, rectangular, durable metal slope, arrange at approximately 50 degrees. Its thickness is 5% to 10%, of its length and its width almost half its length.

Its leading edge 20, FIGS. 5,6,8, and 9 and approximately the first one third, is optionally leading edge pointed 20*a*, leading edge narrowed 20*b*, and leading edge 20 of inclined plane 22, a wear edge 27 thickened for use in consolidated and abrasive earth. Its leading edge 20 fractures and cleaves. The final approximate two thirds of inclined plane (22), up lifts excavated earth above and beyond its attachment to the implement (28). This arrangement offers stabilizing forces, to help compensate the bending forces of the forward overhang at approximately a midsection support, that happens during maximum effort.

Incline plane (22) is attached rearward of this approximately midsection support and is attached to the implement (28) by a mounting socket (32, FIGS. 2,7, and 8) or by a fastener (23, FIGS. 5,6, and 9) and incorporating thrust block(25).

Accompanying clean up edge (24), is approximately half the length of inclined plane (22), and one is located on each side of inclined plane (22, FIGS. 5 and 6). Each fills half the gap between the inclined planes (22). They are constructed to attach to the implement (28) with their upper extremities the same height as the inclined plane (22). Clean up edges (24) attach integral to the inclined plane, or they may simply adjoin attached only to the implement (28).

Working more than one inclined plane (22) in unison and arranged to bridge cleave, results in little to no abrasion to the implement (28), superior excavation performance, and excellent staying. This inclined plane earth engaging tool can require considerably less energy or horsepower to perform the same task of known earth engaging tools.

(End Summary of Operation)

There are several objects and advantages of my overhung inclined plane 22. It accomplishes aggressive fracturing, cleaving and heaving of earth excavation at a lesser power requirement while performing many extra hours of service. This means more production at less cost.

In FIG. 1, the inclined plane 22 resembles the simple machine by the same name. As an earth working implement, it is the inclined plane 22 with an integral mounting socket 32 or the inclined plane 22 earth engaging tool. It is constructed of durable metal on the top and front side for its exposure to extreme abrasion that can be encountered in earthen excavation.

It is important to note that, when added, the services of the tooth 30 and the former cutting edge 34 are replaced by the inclined plane 22 and the accompanying new clean up edge 24.

It is important to note that the cleavage of the excavation has been moved downward and forward of the original location. Comparing FIG. 1 with FIG. 2 and FIG. 9, it is easy to recognize that the inclined plane 22 starts out about one third longer than the tooth 30 and as the amount of use progresses the inclined plane 22 rapidly increases to one and a half times the length.

The rearward overhang, on its underside is supported on the top of the implement 28. During down pressure loads, this overhang offers extended moments between support and the attachment components, rearranging much of the attachment component work from bending to shear. This has an additional bonus in working against much larger attachment component service areas significantly increasing their service life. Also this great length of the inclined plane 22 uplifting earthen excavation offers compensating forces for added strength to the attachment of the inclined plane.

The final approximate two thirds of inclined plane 22, atop up lifts excavated earth above and beyond its attachment to the implement 28. This arrangement offers stabilizing forces, to help compensate the bending forces of the forward overhang at approximately midsection support, that happens during maximum effort. Incline plane 22 is attached rearward of this approximately midsection support and is attached to the implement 28 by a mounting socket 32, FIGS. 2,7, and 8 or by a fastener 23, FIGS. 5,6, and 9 and incorporating the thrust block 25.

It is important to note that the cleavage of the excavation with a series of inclined planes 22 will likely establish an end fracture or a bridged cleavage line sloping upward approximately 0.4 horizontal to 1.0 vertical in many soil applications. It becomes apparent that the deeper that the earth is cleaved, the more frequent a definite fractured and cleaved line will appear. This information can effect where the designer might place the inclined plane 22. It is for this reason that the 66% cut with a 34% leave out becomes most common or usual. However, optimum percentages of cut can range from 50% to 90% of cut, depending on the characteristics of the excavation.

When added, the inclined plane 22, making a 66% cut mostly accomplishes the combined work of the teeth 30, FIG. 1 initially fracturing and cleaving part of the earthen excavation and then the former cutting edge 34, FIG. 3 fracturing and cleaving the balance.

By avoiding dual encounters, cycle time can be reduced and production can be increased to a superior rate by the same machine. This is accomplished by the inclined plane 22 achieving such a high percentage of singular earthen engagement.

Near singular earthen engagement might best be explained in this manner. Making a 66% cut with a 34% leave out, more than one adjacent inclined planes 22 can and often quickly establish a bridged cleavage from one inclined plane 22 to the other. This fact is well established and supported by the minimal wear of the clean up edge 24 as compared with the considerably greater wear of former cutting edges 34. A clean up edge 24 has minimal cleavage to perform. They wear so slowly that they handily can be welded on.

Two inclined planes 22 followed by their companion clean up edge 24, FIGS. 5 and 6 can aggressively cleave and load earth while nearly totally isolating excavation and its abrasion from the structural components of the inclined plane 22, the adapter 26, and the implement 28.

Because the designer can design a much simpler structure for an implement 28. The work application which formerly required a lip for all needs, as for sacrificial metal, and good fluid dynamics design, has become unnecessary. When using the inclined plane 22, with the accompanying clean up edge 24, the implement 28, FIGS. 5, 6, and 9, is used nearly totally for structure.

There is little wear structure needed, and little enhancement needed for fluid dynamics, only the possible area beyond the inclined plane. This can be greatly effected by adjusting the discharge angle and height of the inclined plane 22.

The adapter 26 is a conventional item of prior art. It is necessary that the adapter 26 and the tooth or mounting socket 32 be durable and compatible. A selected line as a G H Hensley of Dallas, Tex. offers a world wide supply of matched teeth 30 and adapters 26 that can be incorporated. Their welded nose adapter 26 is most conventional and can be attached to nearly any implement 28.

The implement 28 needs to be only a structural durable mounting platform for the particular adapter 26. A squared off former lip can be readily used for an implement 28. The name lip has intentionally been dropped because the physical shape of the working platform or implement 28 for the inclined plane 22, no longer needs to be a cutting edge 34.

The implement adaption 29 is a durable metal member of sufficient magnitude constructed with prearranged holes to accept a fastener attachment for inclined plane 22 and its accompanying clean up edge 24 shown FIG. 9, and the attachment made integral to the implement 28. The angle of attachment is relevant to the desired angle of ascent of the inclined plane shown in FIG. 9. This implement adaption 29 is a conventional item and is illustrated in FIG. 9. It adds considerable strength to the implement 28.

Any deviation from a single line of clean cleavage between more than two inclined planes 22, is followed by the companion clean up edge 24 to excavate earth not yet cleaved and channel it above the implement 28. Although there is very little remaining excavation, the clean up edge 24 insures that nearly all abrasive earth is isolated from the structure of the implement 28.

The inclined plane 22 is environment friendly. It can increase production approximately 15% for the same machine.

Commencing at the forward end, approximately one third to one half of the ascending length is the heaviest service or wear area, of the entire inclined plane 22.

The leading edge 20 can take on several optional earth engaging shapes, to construct an adaptable leading edge 20. The leading edge 20 of the inclined plane 22 is optionally pointed, narrowed and thickened. The highest wear areas of the inclined plane are shown compensated by the additional sacrificial metal of the wear edge 27 as shown in FIGS. 9 and 10. The rectangular shaped wear edge 27 is approximately the same thickness, the same width, and approximately two thirds the length of the inclined plane 22, and it is attached to the lowers front of the inclined plane 22. Its lower face at the leading edge pointed 20*a* is accomplished by a portion left out on approximately a 45 degree lower corner bevel, increasing the amount of leave out increases pointedness and increases the penetration pressure per area, while using the same effort. The lower forward over lapping wear edge 27 continues its ascending and attachment either cast or fabricated and terminates approximately half the length on the top side of the inclined plane.

This wear edge thickness increase to the first one third to one half the length of the inclined plane is incorporated to help withstand harsh abrasive earthen excavation. The thrust block 25 is added approximately mid way of the wear edge 27, at its support area to its underside FIG. 9, for better attachment under heavy working loads.

Through pointing, narrowing, and thickening, superior fracturing, cleaving, and uplifting are achieved and maintained even in harsh abrasive earthen excavation, where this earth engaging tool finds utility.

A fastener attached inclined plane 22 ascends rearward atop and beyond its attachment to the implement 28 and using this arrangement, it nearly totally isolates the abrasive earth excavation from the implement 28.

Although the inclined plane 22 is predetermined and arranged to ascend at 40 to 70 degrees from the axis of the relative earth engagement, the optimum angle is usually approximately 50 degrees, but different applications can require different angles within the this range.

The optimum angle is important in that it makes my inclined plane 22 self sharpening. At an angle of approximately 50 degrees, the bottom does not wear. The top front does the fracturing and cleaving and in this area it wears the most, making a self sharpening front section of the inclined plane.

Tilting too high, the fracturing and cleaving resistance increases greatly and the wear area moves rearward and self sharpening is diminished. At too flat a penetrating angle the leading edge develops into a wedge and wears mostly into a rounded or blunt leading edge earth engaging tool. This feature is avoided by using an inclined plane at approximately an angle of 50 degrees relative to earth engagement.

Arriving at the proper operating angle of attack of the inclined plane 22 results in aggressive fracturing and cleaving, self sharpening, and staying in this beneficial configuration.

Leaving the leading edge pointed 20*a* and operating within the correct range of degrees of ascent, can make the inclined plane 22 wear as if it is self sharpening.

Working angles of the incline plane 22 can become significant in order to accomplish four objectives simultaneously.

It must first penetrate. Secondly it must fracture or displace the earth. Both the first two tend to blunt the leading edge 20.

Thirdly it must then cleave and heave, it must act as a lifting foil, to make a separation line uplifting the earth. This can be used to advantage by tilting the inclined plane 22 slightly more aggressively, the wear on the top exceeds the wear on the underside, of which there is practically none, and the smallest possible leading edge 20 radius is maintained. Because it is an inclined plane 22, there is no bottom to wear and commence developing a wedge. It does not as usual, lose set or begin to become blunt. The leading edge 20 remains thin or staying.

Fourth, because the wear pattern, of the first one third to one half of the inclined plane 22 is now facing more earthen excavation when the ascent angle is increased, there is a concentration of wear in this first third to a half of the inclined plane. This additional abrasion is combated with a wear edge 27, an additional thicker metal section on the top front, FIG. 10 of the inclined plane. This wear edge 27 is intended to be sacrificial and wear into a thin section starting in front and progressing rearward slightly faster than the leading edge 20 wears rearward. The steeper engaging angle makes the incline plane excavate more aggressively and it will be more productive. Because the leading edge 20 maintains a sharp profile, it will require less draft, less energy.

An inclined plane 22, FIG. 2, attached to a mounting socket 32 commences an integral attachment about a fourth of the way ascending. This attachment continues, and then terminates at the rearward face of the mounting socket 32 at approximately three fourths the length of the ascending underside.

A fastener 23 attached inclined plane commences attachment as soon after the working support as possible and it terminates at its farthest distance rearward of the support section that a fastener 23 can be installed to gain mechanical advantage to its attachment to an implement adaption 29.

Under load, the area of support of an inclined plane 22 is approximately midway, the area of attachment is generally more rearward and more wide spread.

An inclined plane 22 can be cast or fabricated.

Attached to the rear face of the mounting socket 32, a mating nose of an adapter 26 is attached to an implement 28, FIG. 2. A predetermined angle to arrange the desired angle of the inclined plane 22 before attachment to the implement 28. The inclined plane 22 can be used singularly or several at a time.

Continuing from the termination of the rear face of the mounting socket 32, approximately the final one fourth, of the underside of the ascending inclined plane 22, makes a flat contact fit as it rests on the upper side of the adapter 26. The adapter 26 is equipped to firmly underlay the lower face of the inclined plane 22 at a rear most location for the greatest mechanical advantage and additional support to the adapter 26.

This connection is shown attaching by several fasteners 23, to the inclined plane 22, and more fasteners 23, FIG. 9, can be added if additional security be desirable.

The ascending incline plane 22, at its leading edge 20, is configured with its leading edge pointed 20*a*, and leading edge narrowed 20*b* and leading edge thickened by a wear edge 27 of FIGS. 5 and 6. In FIGS. 9 and 10 we see the inclined plane 22 with its leading edge 20 and a wear edge 27 configured with its leading edge pointed 20*a* and thickened with a wear edge 27. These optional configurations commence to penetrate, fracture, and then cleave. Following the leading edge 20, the whole inclined plane comes to life by following through with the cleaving the heaving and uplifting of the oncoming earth.

At approximately the final one fourth length of the ascending inclined plane 22 to its extremity, there are several important functions.

First is to offset both the heavy and the harsh abrasion as earthen excavation continues to uplift.

Second is to support this section of the inclined plane 22 with the top of the adapter 26 or implement 28, for additional structural support.

Third is to nearly totally isolate the under sides of the inclined plane 22 and its structural components and attachments and the undersides of the implement 28 of abrasive earthen excavation.

The fourth function of the final one fourth of the inclined plane 22, acts as a stabilizer. A flush fit and additional attachment with the adapter 26 or an implement 28 for an inclined plane 22, or an implement 28 for several inclined planes 22 can add additional structural support to the stabilizer end of the inclined plane 22. This supporting of the rearward section of the inclined plane 22, can reduce bending moments and change some components to shear, a very desirable change.

The uplifting of the earthen excavation at the rearward end of the inclined plane tends to compensate the bending forces pulling downward on the front of the inclined plane 22.

It must be noted that the leading edge 20 of the incline plane 22 incorporates the highest possible forces per area, because of its reduced area by a leading edge pointed 20*a* and a leading edge narrowed 20*b*.

The optimum arrangement of the incline planes 22 attached to the front of the lip or implement 28 can vary for a particular application. Evenly spaced at 66% cut, and 34% gaps between cuts, the incline plane 22 will frequently cleave across the gaps during deep or aggressive digging.

Example: a 3 meter lip with 7 inclined planes 22, @66% of cut=0.43 meter intervals, approximately 0.281 meter wide inclined planes 22, and approximately 0.566 meter long. There would be 7 of them and a approximately 0.063 meter between them. The cleavage would be expected to extend approximately 0.056 meters past each side of the inclined plane 22, which would mean that it is likely the cleavage lines would meet.

The inclined plane 22 tends to make an almost straight cleavage line between the cuts even though, with lesser percentage of cut there can be considerable gap between them. This cleavage occurs very similar to the cleaving or splitting of a piece of ice after it has been line picked with a swelling pressure applied. It is as if the exertion of the inclined plane were initiating a controlled line break, by a forward and an uplifting motion.

This line of penetration happens at the insertion of the row of the inclined plane 22 mounted on an implement 28 as they contact the undisturbed earth.

With proper forward motion, an inclined plane 22 cleaves the earth more deeply than is usually anticipated.

The sacrificial metal included in an inclined plane 22 can run over three times the sacrificial metal of an earth working tooth of prior art. This can result in many more times the useful life. The rear most portion of the incline plane 22 acts as a stabilizer, and a structural enhancement. It is intended to be a prime source of uplift of excavated earthen materials. Also it nearly totally prevents abrading the implement 28 rearward of the inclined plane 22.

A thin coat of residual earth on the implement rearward of the inclined plane 22 usually indicates that there can be very little abrasion as long as this condition exists.

Increasing the height of the earthen discharge off the upper end of the inclined plane 22 can increase the deposition of residual earth on the implement. Too much of this can be undesirable.

However, reducing the height of the discharge end, by shortening the rearward length of the inclined plane 22, as well as reducing the height of the accompanying cutting edges can reduce a thin coat of the earthen deposition to bare metal on the implement 28 and can restart abrasion of the implement 28 can also restart abrasion of the implement 28, as is common to the lip of the prior art. A thin earthen protection deposit in the implement 28 area can assure good erosion control for areas rearward of the inclined plane 22.

With the exception of the top of the inclined plane 22, no appreciable wear occurs. At the junction of the inclined plane 22 and the mounting socket 32, the paint can usually be seen by washing, at any point in the life of the inclined plane 22. This lack of wear is the result of isolating earthen excavation from the lower portion of the inclined plane 22, its structural components and those of the adapter 26 and the implement 28.

Because the inclined plane 22 protects the adapter 26 and the implement 28 so well, better structural design can be incorporated into the implement 28 and much less investment needs to be spent for the implement 28 to be beveled, narrowed and thickened as does a lip of prior art for ground engagement or abrasion resistance.

The overhung rearward end of the inclined plane 22 is sufficiently extended that it can stabilize and reduce bending moments. It can overhang rearward as much as 25% of its length, but this may be increased or decreased.

Conclusion, Ramifications, and Scope of Invention

The reader will see that an inclined plane performs many serious tasks not provided by prior art.

While my above description contains many specificities, these should not be construed as limitations on the scope of the invention, but rather as an exemplification of one preferred embodiment thereof. Many other variations are apparent. For example less mechanism is required to incorporate an inclined plane. The inclined plane offers many leading edge and abrasion protection possibilities and still retain the aggressiveness for consolidated earth.

An inclined plane could be set to make a 90 percent cut and a 10 percent leave out for softer excavation, or the front could be sharpened serrated to cut brush or vegetative growth.

Durable metal extensions of strength and hardness could help to further improvements.

I claim:

1. An earth engaging tool adapted to be attached to an earth working implement, comprising;

a generally rectangular shaped metal inclined planar member having a midsection, a width and a length, with the width approximately half the length, and with said inclined planar member having a thickness approximately 5% to 10% the length, with said inclined planar member being attached to an attachment element having a proximal end and a distal end, said attachment element adapted to attach said inclined planar member to said earth working implement, said inclined planar member being supported at an underside surface thereof, at approximately the midsection, with said inclined planar member protruding beyond the proximal end of said attachment element a distance of approximately one fourth said length and with said inclined planar member protruding beyond the distal end of said attachment element approximately one fourth said length.

2. The earth engaging tool of claim 1, further comprising said attachment element including a mounting socket adapted to connect said attachment element to said earth working implement.

3. The earth engaging tool of claim 1, further comprising at least one fastener adapted to connect said attachment element to said earth working implement.

4. The earth engaging tool of claim 1, further comprising said inclined planar member having a pointed leading edge.

5. The earth engaging tool of claim 4, further comprising said pointed leading edge having an approximately 45 degree corner bevel.

6. The earth engaging tool of claim 4, further comprising a rectangular shaped metal wear edge having a thickness approximately equal to the inclined planar member thickness, a width approximately equal to the inclined planar member width, and a length approximately half the inclined planar member length, with said wear edge attached to a lower forward topside portion of the inclined planar member, said wear edge having a pointed front end and a rear end terminating at approximately one third the length of the inclined planar member.

* * * * *